US007628742B2

(12) United States Patent
Weaver

(10) Patent No.: US 7,628,742 B2
(45) Date of Patent: Dec. 8, 2009

(54) PHYSICAL TRAINING SYSTEM

(76) Inventor: Lloyd Weaver, 23441 Golden Springs, #335, Diamond Bar, CA (US) 91865

( * ) Notice: Subject to any disclaimer, the term of this patent is extended or adjusted under 35 U.S.C. 154(b) by 0 days.

(21) Appl. No.: 11/748,381

(22) Filed: May 14, 2007

(65) Prior Publication Data

US 2007/0287616 A1 Dec. 13, 2007

Related U.S. Application Data

(60) Provisional application No. 60/809,192, filed on May 30, 2006.

(51) Int. Cl.
*A63B 21/02* (2006.01)

(52) U.S. Cl. ..... 482/125; 482/124; 482/126

(58) Field of Classification Search ..... 482/121, 482/122, 124–126, 88
See application file for complete search history.

(56) References Cited

U.S. PATENT DOCUMENTS 843,478 A * 2/1907 Muller ..... 482/124
866,495 A * 9/1907 Marks ..... 482/124
2,097,376 A * 10/1937 Marshman ..... 482/124
4,245,840 A * 1/1981 Van Housen ..... 482/124
5,176,377 A * 1/1993 Wilkinson ..... 482/120
5,263,916 A * 11/1993 Bobich ..... 482/124
5,306,222 A * 4/1994 Wilkinson ..... 482/124
5,372,565 A * 12/1994 Burdenko ..... 482/124
5,545,113 A * 8/1996 Bobich ..... 482/125
5,688,213 A * 11/1997 Recker ..... 482/125
5,792,034 A * 8/1998 Kozlovsky ..... 482/124
5,813,955 A * 9/1998 Gutkowski et al. ..... 482/124
5,993,362 A * 11/1999 Ghobadi ..... 482/124
6,287,242 B1 * 9/2001 Fray ..... 482/121
2005/0059537 A1 * 3/2005 Hull ..... 482/124

* cited by examiner

*Primary Examiner*—Loan H Thanh
*Assistant Examiner*—Allana Lewin

(57) ABSTRACT

A physical training device for a boxer that simultaneously trains the major arm and leg muscles. Elastic cords attached to both feet and both arms of the boxer interact to put tension on the arms when the feet are being moved and vice versa.

2 Claims, 2 Drawing Sheets

PHYSICAL TRAINING SYSTEM

CROSS-REFERENCE TO RELATED APPLICATIONS

This application claims the benefit of Application Ser. No. 60/809,192 filed May 30, 2006 for a Physical Training System.

BACKGROUND OF THE INVENTION

1. Field of the Invention

The present invention relates generally to improvements in exercise equipment and more particularly, pertains to a new and improved physical training system uniquely adapted to the body of the exerciser.

2. Description of Related Art

In the field of fitness training for athletes such as boxers, it has been the practice to employ deadweight bags for training of the arms, and jump ropes, for example, for training of the legs. Such devices have been useful but are incapable of exercising a simultaneous combination of arm and leg muscles as needed in an actual bout.

SUMMARY OF THE INVENTION

The general purpose of this invention is to provide a physical training system for a boxer that not only trains the major arm and leg muscles as do the deadweight bag and jump rope, while at the same time providing training for the arm and leg muscles simultaneously in a more to simulate an actual bout. To do this, the present invention provides a left and right handle for grasping and a left and right foot fastener. A left elastic end is attached to the left handle and left foot fastener. A right elastic cord is attached to the right handle and right foot fastener. When the cords are being grasped by the handles as they extend from the foot fastener across the back and over the shoulders of the athlete, movement of the athlete's legs applies a resistance to the arms and movement of the athlete's arms applies a resistance to the legs.

BRIEF DESCRIPTION OF THE DRAWINGS

The exact nature of this invention, as well as the objects and advantages thereof, will become readily apparent upon consideration of the following detailed description in conjunction with the accompanying drawings in which like reference numerals designate like parts throughout the figures thereof and wherein.

DETAILED DESCRIPTION OF THE PREFERRED EMBODIMENTS

Figure 1:
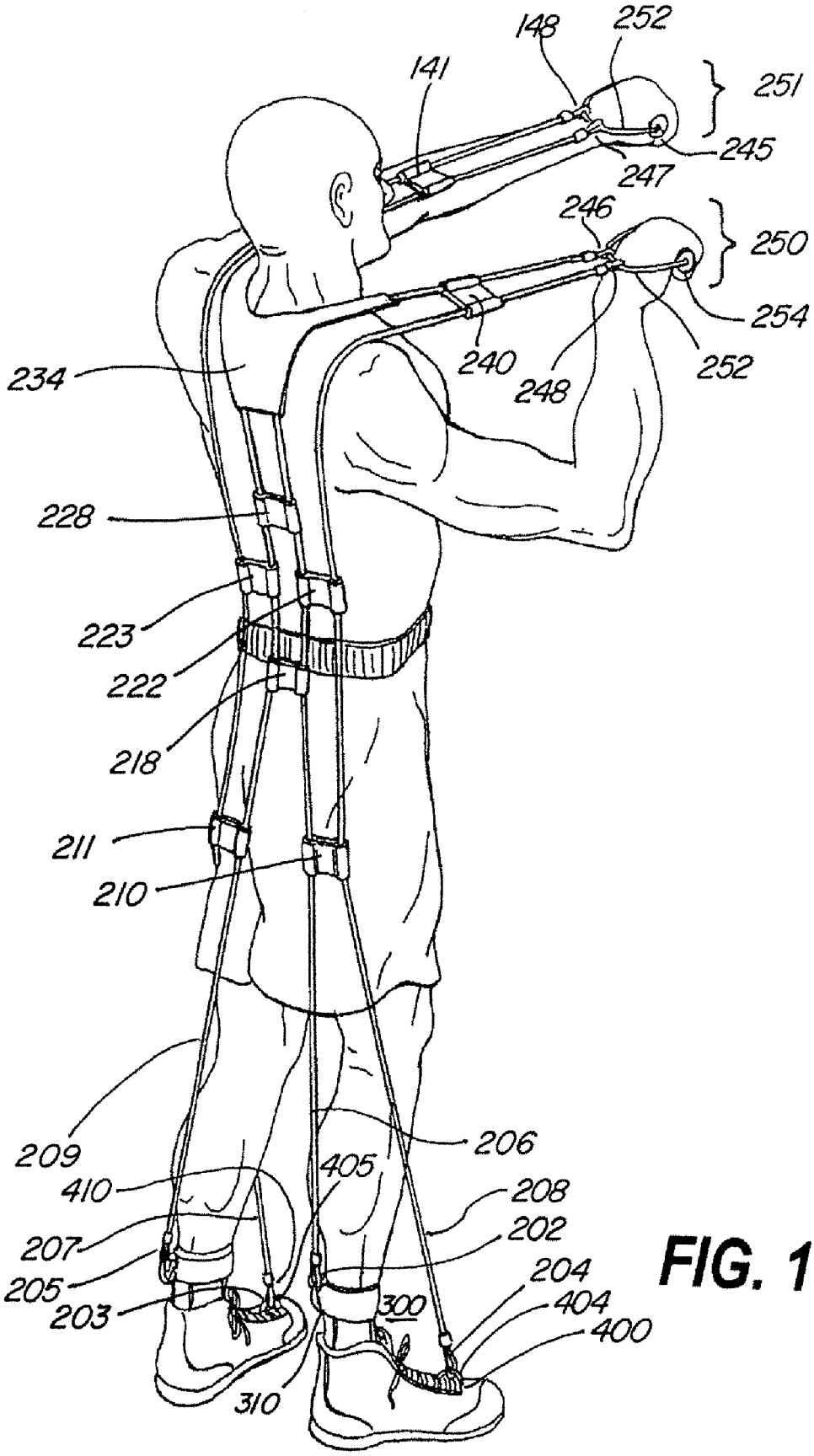
FIG. 1 is a pictorial illustration of a boxer using the invention.

FIG. 1 shows the physical training device 200 in use. Attachment hooks 202 and 203 are attached to attachment rings 304 and 305 of ankle fasteners 300. The attachment hooks 204 and 205 are attached to the curved attachment loops 404 and 405 of the toe fasteners 400. A shoulder harness 234 is properly positioned to protect the user's shoulders from being impacted by the elastic, such as rubber cords 206 and 207. The user athlete is shown properly grasping the handles 250, 251 in an exercise position. All forward thrusts by the arms will keep the shoulder harness in place.

Figure 2:
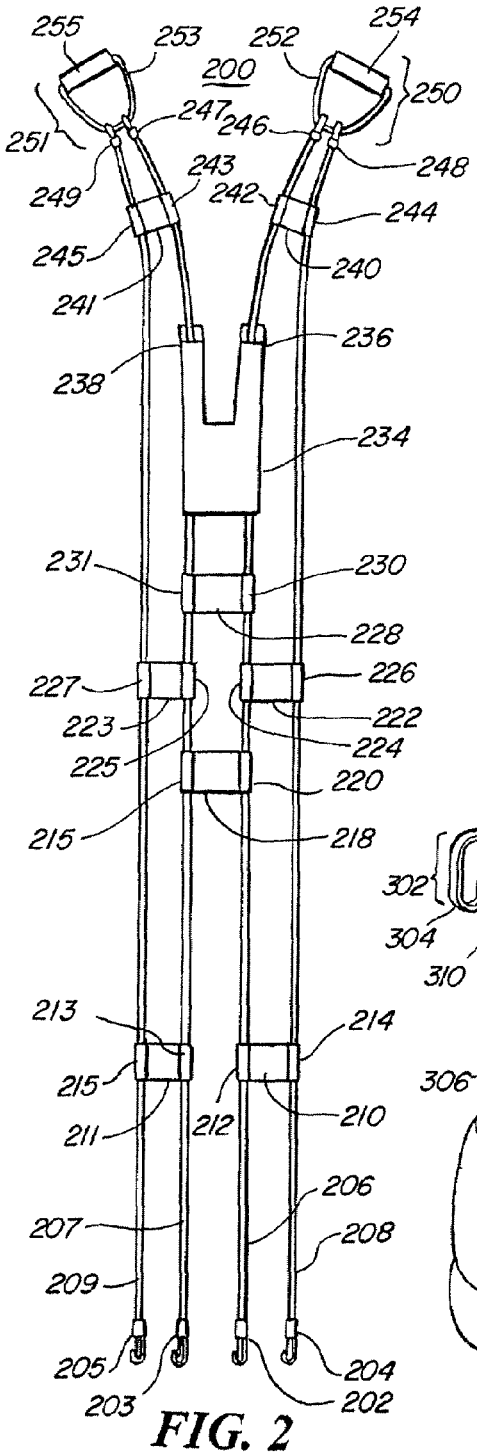
FIG. 2 is a top plane view of a preferred embodiment of the current invention.

The training device 200 is designed for an athlete, such as a boxer. As shown in FIG. 2, a series of elastic cords, such as surgical rubber tubes form the main structure of training device 200.

As shown in FIG. 2, attachment hook 202 attaches to one end of a rubber cord 206. Attachment hook 204 attaches to one end of a rubber cord 208. Attachment hook 203 attaches to one end of a rubber cord 207. Attachment hook 205 attaches to one end of a rubber cord 209. A rectangular web piece 210 has sleeves 212 and 214 at both ends. Rubber cords 206 and 208 are contained by sleeves 212 and 214, respectively. A rectangular web piece 211 has sleeves 213 and 215 at both ends. Rubber cords 207 and 209 are contained by sleeves 213 and 215, respectively. A web piece 216, with sleeves 218 and 220, contains rubber cords 206 and 207. Web piece 222, with sleeves 224 and 226, contains rubber cords 206 and 208. Web piece 223, with sleeves 225 and 227, contains rubber cords 207 and 209. Web piece 228, with sleeves 230 and 232, contains rubber cords 206 and 207.

A shoulder harness 234 made of a soft material to protect the shoulders from being impacted by the rubber cords, has sleeves 236 and 238. Rubber cords 206 and 207 are fed through and contained by sleeves 236 and 238, respectively. A web piece 240, with sleeves 242 and 244, contains rubber cords 206 and 208. A web piece 241, with sleeves 243 and 245, contains rubber cords 207 and 209.

Attachment hook 246 attaches to the other end of rubber cord 206. Attachment hook 248 attaches to the other end of rubber cord 208. Attachment hook 247 attaches to the other end of rubber cord 207. Attachment hook 249 attaches to the other end of rubber cord 209. A pair of plastic handles 250, 251 have U-shaped portions 252 and 253 and straight portions 254 and 255. Attachment hooks 246 and 248 attach rubber cords 206 and 208 to U-shaped portion 252 of handle 251. Attachment hooks 247 and 249 attach rubber cords 207 and 209 to U-shaped portion 253 of handle 250. The straight portions 254 and 255 may be fitted with a soft grip.

Figure 3:
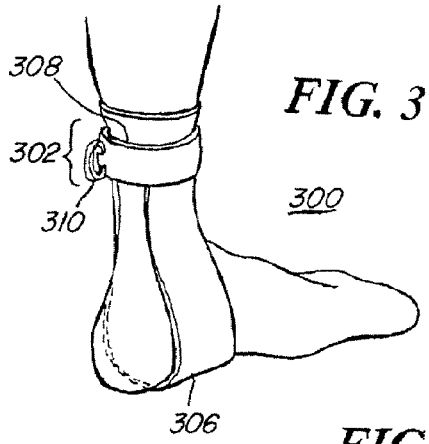
FIG. 3 is a perspective of a preferred embodiment of a leg connector of the present invention.
Figure 4:
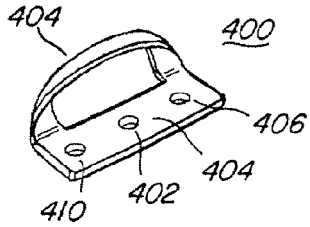
FIG. 4 is a perspective view of a preferred embodiment of a shoe connector of the present invention.
Figure 5:
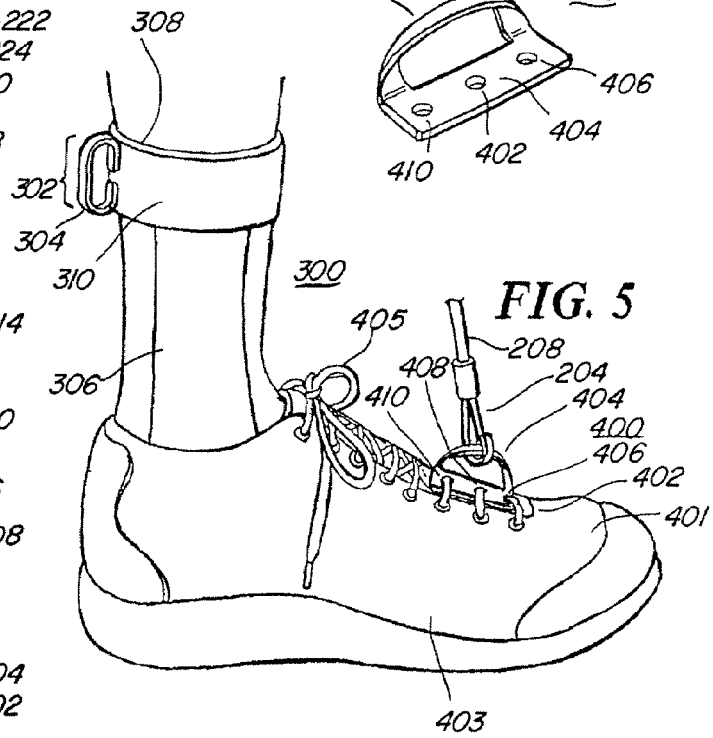
FIG. 5 is a pictorial illustration of the preferred embodiment of the leg connector and shoe connector of the present invention connected to the leg and shoe of a boxer.

Foot attachments and fasteners are shown in FIGS. 3-5. The foot attachments are left and right ankle fastener 300 and 301 and toe fasteners 400, 401, interlaced with the user's shoelaces.

As shown in FIG. 3, the ankle fastener 300 has an upper section 302, which is a mock up of a ring of expandable material or a Velcro™ fastening strip or equivalent structure, that slips over a user's ankle. The interior surface 308 of the ring is thickly padded. Attached to the exterior surface 310 of the ring is an attachment loop 304. Attachment hook 202 of rubber cord 206 attaches to attachment loop 304. A heel strap 306 is an integral part of the upper section 302 by being attached to the interior surface 308 of the upper section 302.

As can be seen in FIG. 4, a toe fastener 400 is preferably made of a single piece of plastic, which has of a flat portion 402 and a curved attachment loop 404. The flat portion 402 contains shoelace holes 406, 408, and 410, which allow the toe fastener 400 to be interlaced with the user's shoelaces at the toe 401 of the shoe 403. Attachment hook 204 of end 208 attaches to curved attachment loop 404, for example.

FIG. 5 shows the toe fastener 400 attached to the toe section 401 of a shoe 403 by the shoelaces 405.

This invention provides a physical training device 200 that facilitates a workout where the aerobic efforts of the user's legs and feet simultaneously impacts the effort required by the arms. FIG. 1 shows the physical training device 200 in operation. The physical training device 200 is particularly applicable to, but not limited to, training for boxing, tennis, baseball, basketball, football, and aerobic conditioning.

Cords 206, 207, 208, and 209 which may be surgical rubber tubing may be made in small, medium, and large lengths. The thickness of the rubber for rubber cords 206, 207, 208, and 209 can also be made in light, medium, and heavy thicknesses for different workout levels. The thickness of the rubber for rubber cords 206, 207, 208, and 209 does not need to be the same for each. For example, a right handed person may want rubber cords 206 and 208 to be thicker than rubber cords 207 and 209. A person may also want different thicknesses for rubber cords 206 and 208. For example, a person may want 206 to be of medium thickness and 208 to be of heavy thickness for a workout level between medium and heavy. Webbing pieces 210, 211, 216, 222, 223, 228, 240, and 241 can either be fixed in place or adjustable.

To use the physical training device, a user will first put on ankle fasteners 300 and 301 by placing the feet through the upper sections 302 and 303 and resting the heels against heel straps such as 306. The user will then put on his shoes and interlace the toe fasteners 400 and 401 into the shoelaces of their shoes 403 at the toe 401. The user then connects attachment hooks 202 and 203 to attachment rings 304 and 305, and attachment hooks 204 and 205 to curved attachment loops 404 and 405. The user will then grasp plastic handles 250 and 251 and manipulate the arms to position shoulder harness 234 in a comfortable location.

This physical training device 200 exercises several muscle groups at the same time. When the user makes a forward or lateral step with the right foot, web pieces 216 and 218 hold rubber cords 206 and 207 together, forcing them to expand, increasing the amount of resistance, and thus increasing the force required to make a step. This step will also force rubber cord 208 to expand and additionally increase the amount of resistance. In turn, the expansion of rubber cords 206 and 208 will increase the resistance to the user's attempts to fully extend the arm in a punching motion.

When a user extends the right arm forward in a punching motion, for example, rubber cords 206 and 208 will expand and increase the amount of resistance felt. This increased resistance will require the user to apply additional downward force in order to keep their foot planted. When the user throws a punch, they will likely be simultaneously extending their arm and leg, which will simultaneously increase the amount of force required to fully extend the arm and leg, due to the increased resistance provided by the expansion of rubber cords 206 and 208.

There are a great number of exercises that can be done with physical training device 200, beyond the motions described above. A user can perform any numbers of combination of arm and leg motions in conjunction with one another. The training device 200 is uniquely adaptable to the great variety of arm and leg movements possible in a number of sports.

Various modifications of the invention are contemplated by the inventor, and they obviously will be resorted to by those skilled in the art without departing from the spirit and scope of the invention as hereinafter defined by the appended claims.

What is claimed is:

1. A personal training and exercising device for a human body, consisting of:

a left handle for being grasped by the left hand of an exerciser;

a right handle for being grasped by the right hand of the exerciser;

a left foot ankle fastener for fastening to the left ankle of the exerciser;

a left foot toe fastener for fastening to the left toe area of the exerciser;

a right foot ankle fastener for fastening to the right ankle of the exerciser;

a right foot toe fastener for fastening to the right toe area of the exerciser;

a first left and second left resistance cord, the first left and second left cords being attached to the left handle, the first left cord being attached to the left foot ankle fastener, and the second left cord being attached to the left foot toe fastener;

a first right and second right resistance cord, the first right and second right cords being attached to the right handle, the first right cord being attached to the right foot ankle fastener, and the second right cord being attached to the right foot toe fastener; and a shoulder harness resting on the shoulders of the exerciser for routing the first left cord and the first right cord from respective ankle fasteners over the exerciser's shoulders to respective handles;

whereby the second left resistance cord and second right resistance cord from respective toe fasteners are routed over the exerciser's shoulders to respective handles.

2. A personal training and exercising device for a human body, the training device consisting of:

a left handle for being grasped by the left hand of an exerciser;

a right handle for being grasped by the right hand of the exerciser;

a left foot ankle fastener for fastening to the left ankle of the exerciser;

a left foot toe fastener for fastening to the left toe area of the exerciser;

a right foot ankle fastener for fastening to the right ankle of the exerciser;

a right foot toe fastener for fastening to the right toe area of the exerciser;

a first left and second left resistance cord, the first left and second left cords being attached to the left handle, the first left cord being attached to the left foot ankle fastener, and the second left cord being attached to the left foot toe fastener;

a first right and second right resistance cord, the first right and second right cords being attached to the right handle, the first right cord being attached to the right foot ankle fastener, and the second right cord being attached to the right foot toe fastener; and a shoulder harness resting on the shoulders of the exerciser for routing the first left cord and the first right cord from respective ankle fasteners over the exerciser's shoulders to respective handles;

whereby the second left resistance cord and second right resistance cord from respective toe fasteners are routed over the exerciser's shoulders to respective handles;

a web located between the exerciser's knees and waist attaching the first left cord to the first right cord; and a pair of webs located between the exerciser's knees and waist, a first web attaching the first right cord to the second right cord a second web attaching the first left cord to the second left cord.

* * * * *